United States Patent [19]

Kurosawa

[11] Patent Number: 4,623,082

[45] Date of Patent: Nov. 18, 1986

[54] ELECTRONIC STAPLER

[75] Inventor: Mitsuteru Kurosawa, Gumma, Japan

[73] Assignee: Max Co. Ltd., Toyko, Japan

[21] Appl. No.: 733,993

[22] Filed: May 14, 1985

[51] Int. Cl.[4] ..... B27F 7/31; B27F 7/36

[52] U.S. Cl. ..... 227/7; 227/120/131; 206/338

[58] Field of Search ..... 227/3, 5, 7, 120, 156, 227/112, 84; 206/338

[56] References Cited

U.S. PATENT DOCUMENTS

| | | | |
|---|---|---|---|
| 2,943,436 | 7/1960 | Peterssen | 227/120 X |
| 3,156,376 | 11/1964 | Lasting | 227/113 X |
| 3,524,575 | 8/1970 | Hurkmans et al. | 227/7 |
| 3,604,608 | 9/1971 | Mullaney et al. | 227/120 X |
| 3,622,061 | 11/1971 | Hoyer et al. | 227/120 |
| 4,356,947 | 11/1982 | Marshall et al. | 227/84 X |
| 4,542,844 | 9/1985 | Olesen et al. | 227/120 X |

FOREIGN PATENT DOCUMENTS

| | | | |
|---|---|---|---|
| WO82/0009-72 | 4/1982 | PCT Int'l Appl. | 227/131 |

*Primary Examiner*—Paul A. Bell

*Attorney, Agent, or Firm*—Cushman, Darby & Cushman

[57] ABSTRACT

An electronic stapler suitable to accommodate staples in the form of staple sheets, in which a predetermined number of unformed staple elements are connected adjacent to one another, and a number of these staple sheets are stacked and accommodated in a generally rectangular cartridge, which is placed above the staple sheet feed path of the stapler. The stapler includes a former-driver unit and a power source for driving the former and the driver is provided by a small-sized electric motor which requires no instantaneous high consumption of electric current and generates no impact operation sound and noise, and the clinching operation of one cycle is effected by one controlled rotation of a rotating drive shaft having a speed reduced from the rotational output of the electric motor. The staple sheets are fed by providing a staple sheet feed mechanism in which an endless belt for conveying the staple sheets, including the portion for positioning the cartridge, is arranged above the staple sheet feed path and in which magnetic means for generating a suitable frictional force is interposed between the face of that endless belt and the staple sheets.

10 Claims, 26 Drawing Figures

ELECTRONIC STAPLER

FIELD OF INDUSTRIAL APPLICATION

The present invention relates to a power-driven stapler which makes use of power to automatically supply staple materials unformed to a clinching portion, to forming the staple materials into U-shaped staples and to drive the formed staples into an object to be stapled.

PRIOR ART AND PROBLEMS THEREOF

The power-driven stapler for forming unformed staple materials into a shape of letter "U" and for subsequently driving the U-shaped staples into an object to be clinched such as already disclosed in the specification which has been laid open as International Pateht Laid-Open No. WO82/00972 to the public.

In this known stapler, an electromagnetic solenoid is used as a driving power source, and a drive current is supplied to a solenoid coil to abruptly actuate a plunger to drive both a forming member (or a former) for forming the staple materials into the shape of letter "U" and a driving member (or a driver) for driving the formed U-shaped staples into the object to be clinched. In the known apparatus, in order to actuate the aforementioned forming member and driving member, a large current is instantaneously supplied to the solenoid coil so that the plunger may take a high initial speed. As a result, the plunger generates high shocking sounds and vibrations when it reaches the end of its stroke, so that the stapler undesirably gives another operator an uncomfortable feeling as an apparatus to be used in an office.

Because of the instantaneous consumption of the high current, moreover, the stapler not only exerts adverse noise upon surrounding electric applicances but also raises a serious problem because it may cause malfunctions in other office devices with similar construction.

Also, the known stapler described above uses as the staple materials an elongated staple web in which straight staple materials are connected in series and adjacent to one another and coiled into a helical shape. Because flexibility is required of the elongated staple web, a flexible film of synthetic resin is applied to one side of the staple web causing a complicated production process which increases the production cost of the staples.

Moreover, a staple cartridge for accommodating the aforementioned staple materials has a generally cylindrical accommodating portion so as to accommodate the helical coil so that it decreases the volume efficiency of the body of the stapler having that staple cartridge, by preventing reductions in size and weight of the stapler in its entirety.

Furthermore, the mechanism of the aforementioned known stapler for feeding the staple materials is arranged on a staple material feed path and is effected by reciprocating in the feeding direction a pawl member made engageable with the staple materials. The worst problem of the feed mechanism of that construction is that the feed of the staple materials is completely stopped in case the connection of the staple materials is unexpectedly cut in the staple cartridge. In other words, the succeeding staple material is not fed from the staple cartridge because its end portion doesn't reach the reciprocating range of the aforementioned feeding pawl member. This raises a serious obstruction to reliability in case the stapler of that kind is to be built into other office devices.

OBJECTS OF THE INVENTION

An object of the present invention is to provide a stapler which has a low power consumption rate and no shocking operation sounds and noises so that it can be smoothly operated, which has no electric noises so that it can be built in another office device and which can be driven by a small-sized motor.

Another object of the present invention is to provide a novel staple material feed mechanism which can accommodate a number of staple materials in a limited space of a stapler body and can reliably feed all the staple materials accommodated to a staple driving portion.

Still another object of the present invention is to provide a staple material cartridge which makes it possible to reduce the size and weight of the aforementioned stapler and which is suitable for the feed mechanism of the stapler.

TECHNICAL MEANS OF THE INVENTION

In order to achieve the above-specified objects, according to the present invention, a power source for driving the former member and the driver member is provided by a small-sized electric motor which requires no instantaneous high consumption of electric current and generates no impact operation sound and noise, and the clinching operation of one cycle is effected by one controlled rotation of a rotating drive shaft having a speed reduced from the rotational output of the electric motor.

Moreover, the staples are contained in the stapler magazine in the form of staple sheets, in which a predetermined number of unformed staple elements are connected adjacent to one another, and a number of these staple sheets are stacked and accommodated in a generally rectangular cartridge, which is placed above the staple sheet feed path of the stapler.

Furthermore, the staple sheets are fed by providing a staple sheet feed mechanism which includes an endless belt for conveying the staple sheets, the operative run of which extends below the sheet-shaped staple sheet feed path the feed mechanism further includes magnetic means below the operative run of the belt for generating a suitable frictional force between the face of the operative run of the endless belt and the staple sheets supported thereon.

DESCRIPTION OF THE EMBODIMENTS OF THE INVENTION

Figure 16:
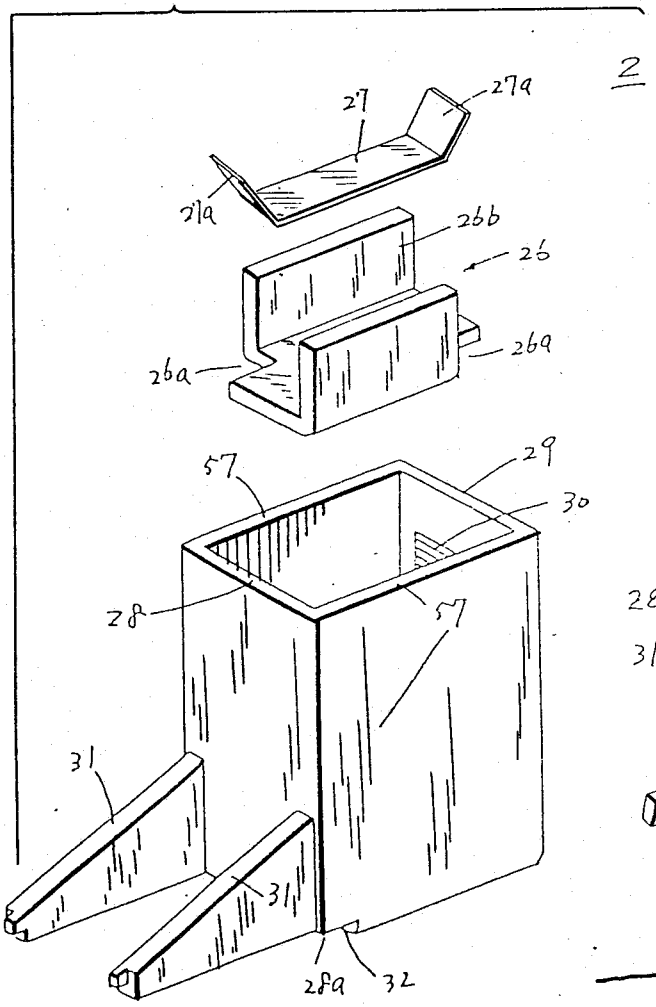
FIG. 16 is an exploded perspective view of the parts of the stapler utilized to handle the supply of staple sheets.
Figure 18:
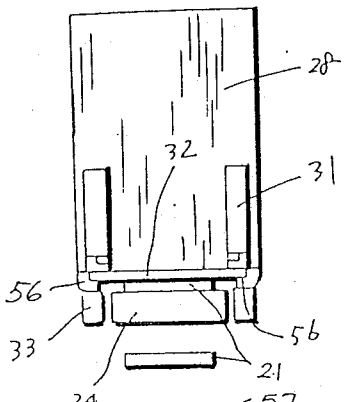
FIG. 18 is a rear elevational view of the parts of the stapler which, are utilized to accomplish the feeding of the staple sheets from the cartridge supply to the forming-driving unit of the stapler.
Figure 17:
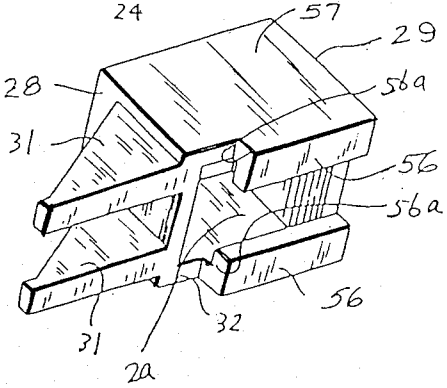
FIG. 17 is a perspective view of the parts shown in FIG. 16 in assembled relation viewed from underneath.
Figure 19:
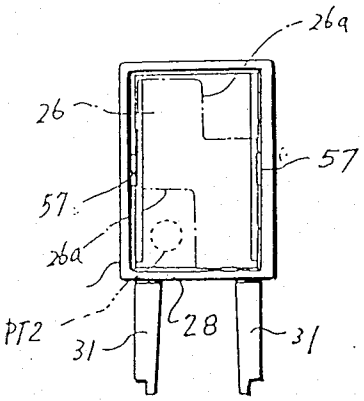
FIG. 19 is a top plan view of the structure shown in FIG. 18.

FIGS. 1 to 5 show a major portion of a stapler 1 according to the present invention and FIG. 16 shows a staple cartridge for use therewith. The stapler 1 is constructed of a base 3, a frame 4 fixed on the base 3, and a hinged assembly 5 hinged to the frame 4. The hinged assembly 5 is constructed of a staple forming-driving unit 6, a staple feeder 7, the staple cartridge 2, and an assembly supporting member 8. The frame 4 supports at its front portion a table 11, which is equipped with a staple clincher 9 and upwardly facing surfaces thereon for supporting an object to be clinched, such as sheets of paper 10. The frame 4 is equipped at its rear portion with a driver 12 (FIG. 5) for driving the hinged assembly 5. The base 3 is equipped with a start switch 13 having its portion projecting to the table 3 so that the driver 12 is started to operate the stapler 1 by pushing the projection of the start switch 13 with the end face of the paper sheets 10 inserted. At the back of the base 3, there is disposed a controller 15 (FIG. 2) for controlling the drive of an electric motor 14. The assembly supporting member 8 has a U-shaped section for hingedly receiving the frame 4 therein and is equipped with a rotating drive shaft 17 to which the rotational output of the electric motor 14 acting as a rotating power supply is transmitted through a reduction gear mechanism 16. The base 3 is formed generally at its center with an engaging portion 19 (FIG. 4) which is made engageable with an engaging projection 18 (FIG. 5) projecting from the hinged assembly 5 to limit the upward turn of the hinged assembly 5 relative to the base 3 to a predetermined position. The rotating drive shaft 17 extends through holes formed respectively in the frame 4, and there is fitted in the central portion of said rotating drive shaft 17, a gear member 22 (FIG. 3) which engages with the undulations 21*a* formed in the inner face of a staple feeding endless belt 21 to rotationally drive the endless belt 21. Another rotating support shaft 23 of the endless belt 21 is borne in the assembly supporting member 8. A magnet member 24 is interposed between the two shafts tensing the endless belt 21 so that the endless belt 21 runs along the upper and lower faces of the magnet member 24. The staple cartridge 2 having its lower face opened can be disposed above the aforementioned endless belt 21 and is positioned in the state in which the lower most staple 25*a* of sheet-shaped staples 25 accommodated in the cartridge 2 has its lower face abutting against the surface of the endless belt 21.

As shown in FIG. 16, the cartridge 2 is formed into a hollow square shape for accommodating in a stacked form the sheet-shaped staples 25 having a predetermined number of unformed straight staple materials connected adjacent to one another, and there is placed on the uppermost one 25*b* of the staples accommodated in the cartridge 2 a push member 26 for pushing the staples in a direction toward the staple feeding endless belt 21. This push member 26 is exemplified in the present invention by a weight for applying a pushing force of gravity but can naturally be replaced by another using a spring or the like. To the push member 26, there is fixed a spring member 27 which has its two end portions 27*a* and 27*a* coacting with undulations 30 formed on the inner faces of front and rear walls 28 and 29 of the cartridge 2 to block the upward movement of the push member 26 but allows the downward movement of the same. Guide members 31 project to the front of the front wall 28 of the cartridge 2. The lowermost staple sheet 25*a* fed out of the staple let-off exit 32 of the lower portion 28*a* of the front wall 28 is moved to the staple forming-driving unit 6 while having its lower side supported by means of a pair of staple guide rails 33 (FIG. 3), which are disposed inside of the assembly supporting member 8, and its upper side guided by the guide members 31 of the cartridge. At the side of the front end 8*a* of the assembly supporting member 8 and below the staple sheet 25 being fed, there is disposed an anvil device 35 which coacts with a staple forming plate 34 to form successive leading unformed staples of the staple sheet 25 into staples having a shape of a letter "U". This anvil unit 35 is constructed of an anvil portion 36, on which the staple sheet 25 is placed, and a pusher portion 38 which is biased to retract relative to said anvil portion 36 by the action of a spring 37. A plate member 39 having a U-shaped section is fixed to the assembly supporting member 8 and above the anvil device 35 across the sheet-shaped staple 25. That plate member 39 has its U-shaped bottom portion 40 facing the staple sheet 25. The plate member 39 is integrally formed at the center of the bottom portion 40 with a projection **40*a* which is directed toward the lower face of said forming plate 34 and which is operative to block the warp of the central portion of the staple being formed and to block the upward movement of the staple while being clamped between the two legs of the forming plate 34** to follow the same after the forming operation.

Figure 1:
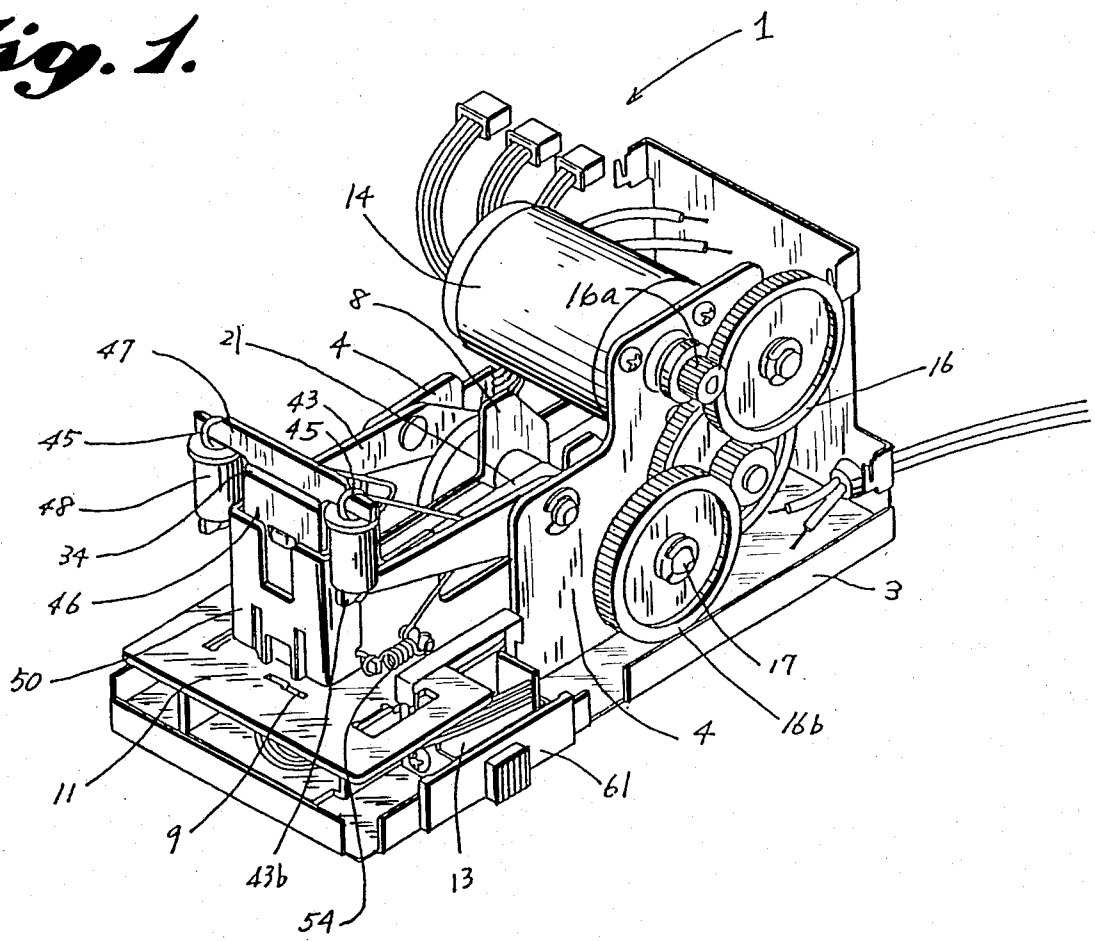
FIG. 1 is a perspective view of an electronic stapler embodying the principles of the present invention.
Figure 2:
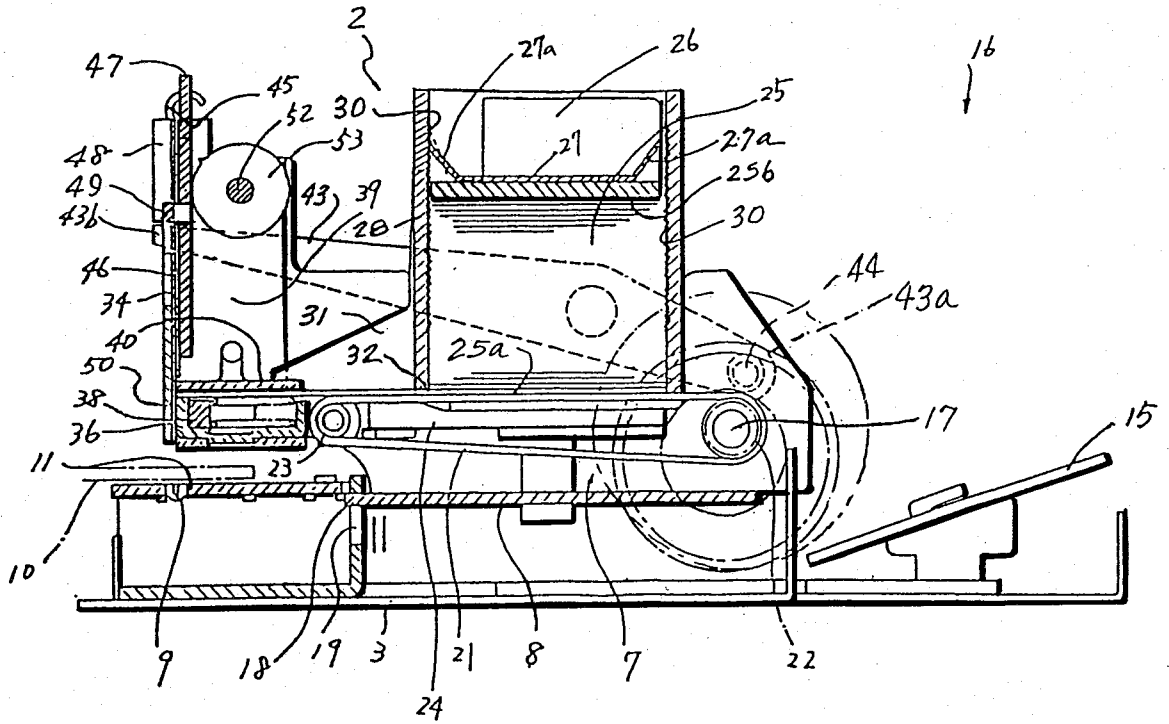
FIG. 2 is a vertical sectional view of the electronic stapler shown in FIG. 1.
Figure 3:
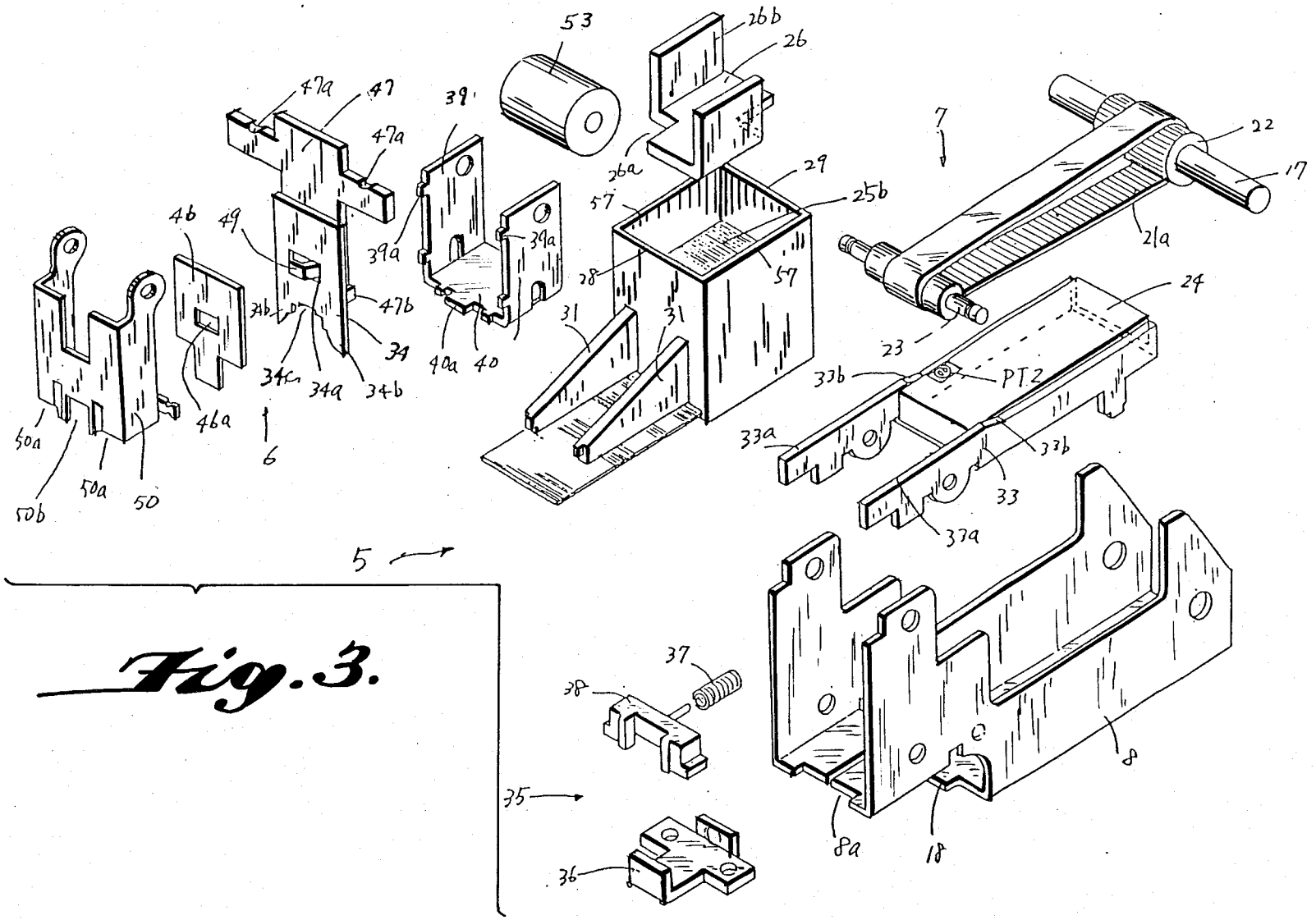
FIG. 3 is an exploded perspective view of certain parts of the stapler shown in FIGS. 1 and 2.
Figure 4:
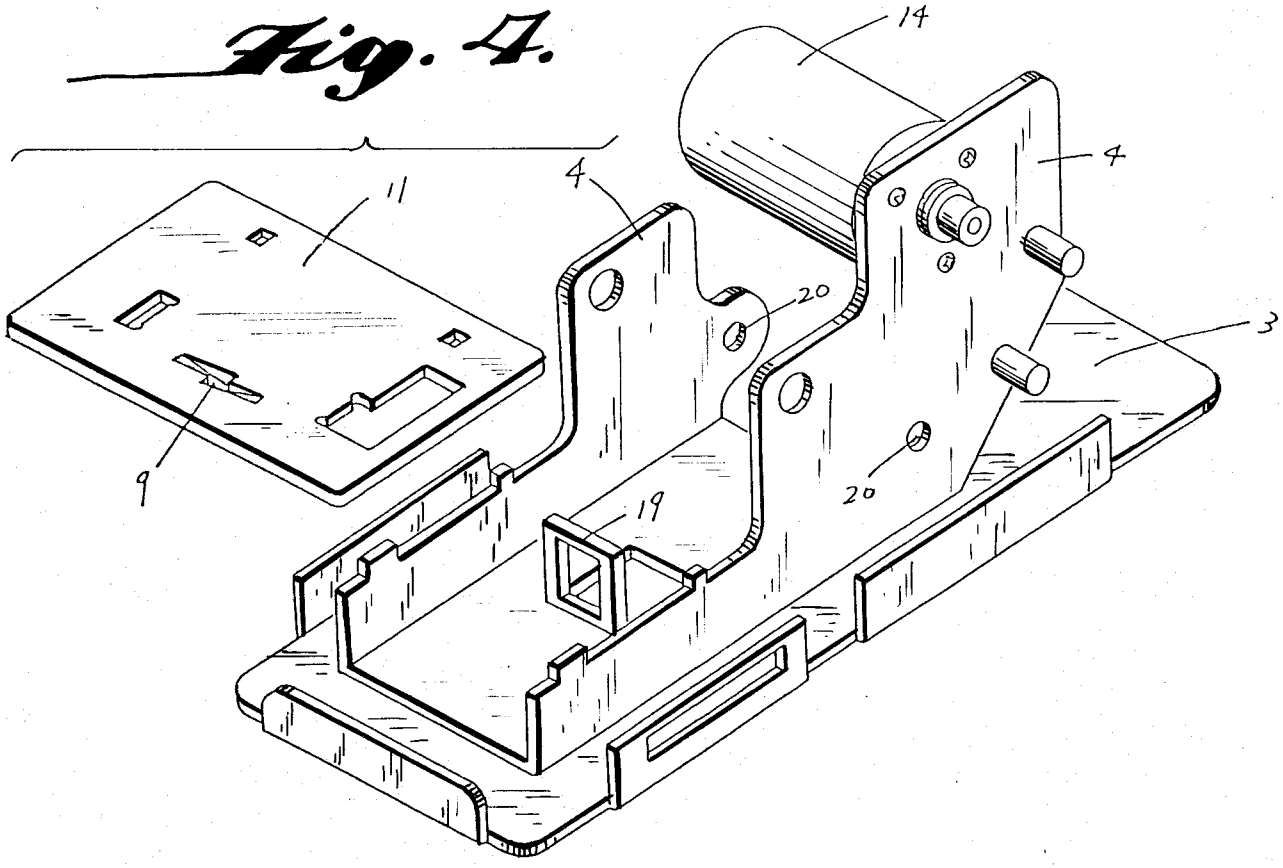
FIG. 4 is an exploded perspective view of certain other parts of the stapler shown in FIGS. 1 and 2.
Figure 5:
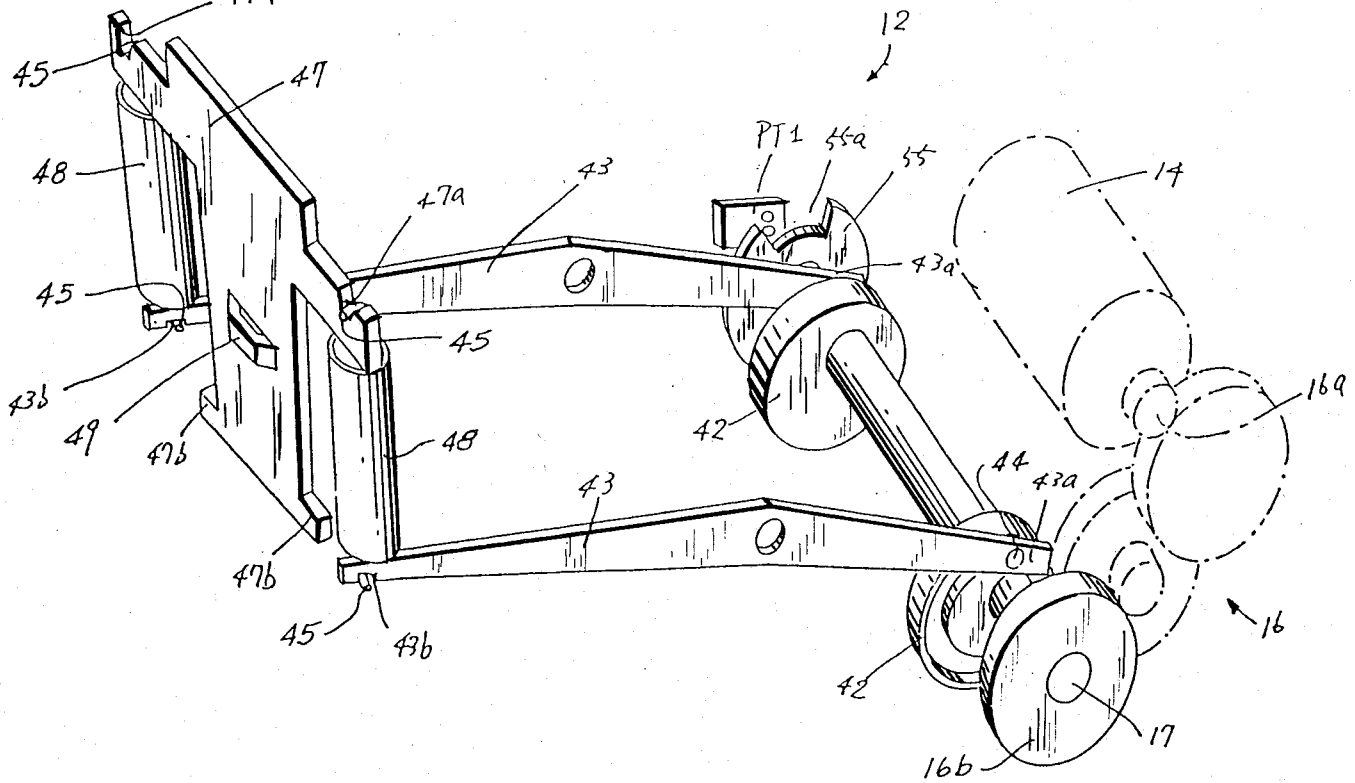
FIG. 5 is a fragmentary perspective view of certain parts of the stapler shown in FIGS. 1 and 2 which illustrate the driving mechanism.

Fixed to the rotating drive shaft 17 is an eccentric cam plate 42 (FIG. 5) which has an annular groove, and a pair of actuating levers 43 have their midway portions hinged to the frame 4. Each of the actuating levers 43 has one end **43*a* thereof supporting a cam roller member 44 fitted in the groove of the cam plate 42 and another end 43*b* connected through a tension spring 45 to a drive holder 47 supporting a driver 46 and the forming plate 34. Each tension spring 45 has its lower end connected in a downwardly facing notch in the associated lever end 43*b* and its upper end connected in an upwardly facing notch on the associated end 47*a* of the drive holder 47. The main body of each spring 45 is accomodated in a cylinder 48. Thus, the actuating levers 43 are reciprocated one cycle about the hinged points in the midway portions thereof by one rotation of the rotating drive shaft 17. During this cycle, the endless belt 21 is caused to run for feeding the staple sheet 25 by the gear member 22 which is fitted on the rotating drive shaft 17. The drive holder 47 is formed at its generally central portion with a supporting projection 49 which is fitted in fitting holes 34*a* and 46*a* formed in the forming plate 34 and the driver 46, respectively, to integrally support the forming plate 34 and the driver 46. The drive 46 supported on driver holder 47 has its front closed by a face plate 50 having U-shaped cross-section, and the driver holder 47 has its rear closed by the plate member 39. The face plate 50 is formed at a lower portion of its back with a pair of vertical lands for guiding the driving portion of the driver 46. The face plate 50 and the plate member 39 have their respective upper portions hinged through the assembly supporting member 8 to a pin 52, on which a guide roller 53 is rotably supported, and the driver holder 47 has its rear face supported by said guide roller 53. On the other hand, the face plate 50 has its lower portion engaged with the assembly supporting member 8 and biased backward by a spring member 54 (FIG. 1). The forming plate 34 and the driver holder 47 holding the driver 46 are reciprocated by one reciprocation of the actuating levers 43**.

The rotational output of the electric motor 14 is gradually reduced in its speed by the gears **16*a* thru 16*b* of the reduction gear mechanism 16, which is disposed at one side of the aforementioned frame 4, so that the aforementioned rotating drive shaft 17 makes one turn during the power supply to the electric motor 14 through a gear 16*b* which is fixed at one end of the rotating drive shaft 17. To the other end of said rotating drive shaft 17, there is fixed a partially cut-away disk 55 (FIG. 5) so that a one rotation end signal of the rotating drive shaft 17 may be obtained from a reflective photosensor PT1 disposed in the frame 4 to face said disk 55. The tension springs 45 connecting the aforementioned actuating levers 43 and driver holder 47 are mounted in the cylinders 48 longer than the natural length thereof. As a result, the cylinders 48 are clamped by the tensions of the springs between the lower faces of spring receiving ends 47*a* of the driver holder 47 and the upper faces of the retaining ends 43*b* of the actuating levers. Moreover, the tension springs 45 mounted in the cylinders 48 are made stronger at least than the clinching load. Simultaneously as the driver holder 47 moves downward for the clinching operation, the assembly supporting member 8 moves downward. This assembly supporting member 8 stops in a position where its front end abuts against the paper sheets 10. However, the actuating levers 43 continuously move on downwardly and the driver holder 47 is pulled downward by the tension springs 45, because these springs 45 are made stronger at least than the clinching load, so that the driver 46 is moved downward to drive the formed staple supplied between the lands 51 of the face plate 50 thereby to clinch the paper sheets 10. And, the tension springs 45 extend longer or shorter in accordance with the stop position of the driver 46 depending upon the thickness of the paper sheets 10. This makes it possible to absorb the difference between the stroke of the driver holder 46 and the stroke of the actuating levers 43** due to the difference in the paper thickness.

In accordance with the upward movement of the other ends of the actuating levers 43, the cylinders 48 move upward so that the driver holder 47 integrally moves upward. As the driver holder 47 moves upward, the assembly supporting member 8 is also moved upward by the resistance between the driver holder 47 and the assembly supporting member 8. This upward movement of the assembly supporting member 8 is limited by the engagement of the engaging projection with the engaging portion of the base so that the top dead point of the assembly supporting member 8 is determined at that position. The driver holder 47 is further moved upward by the actuating levers 43 until it is stopped at the top dead point of the other ends of the actuating levers 43. In case the sliding resistance between the assembly supporting member 8 and the frame 4 is higher than that between the driver holder 47 and the assembly supporting member 8, on the contrary, the projections **47*b* at the lower end of the driver holder 47 come into engagement with the projections 39*a* of the plate member 39 so that the assembly supporting member 8 also moves upward to the top dead center point of the driver holder 47. This point also provides a position in which the engaging projection 18 of the assembly supporting member 8 engages with the upper portion of the engaging portion 19. As has been described above, the assembly supporting member 8 and the driver holder 47 are always held at the same top dead point despite the difference between the sliding resistances. This makes it unnecessary to provide the spring members which are to be used for positioning the assembly supporting member 8 at a predetermined spacing from the base 3**.

Figure 6:
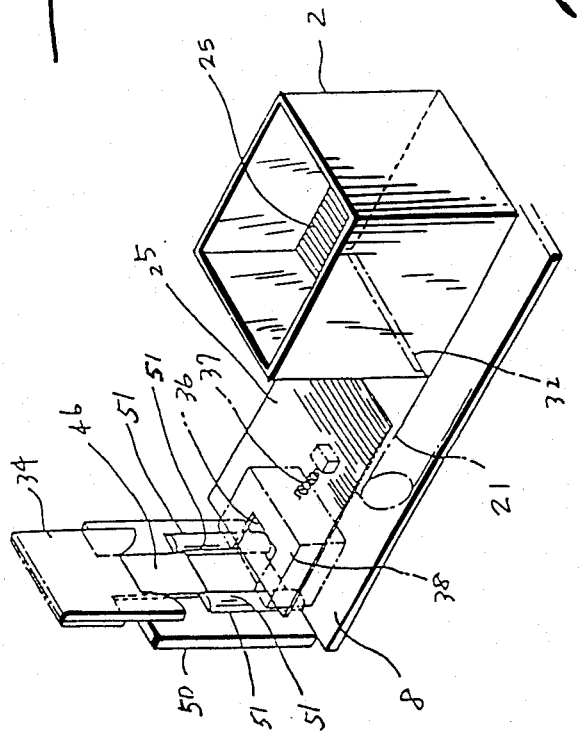
FIG. 6 is a fragmentary perspective view of certain parts of the stapler illustrating the manner in which the staple supply is handled and fed to the former-driver unit of the stapler.
Figure 14:
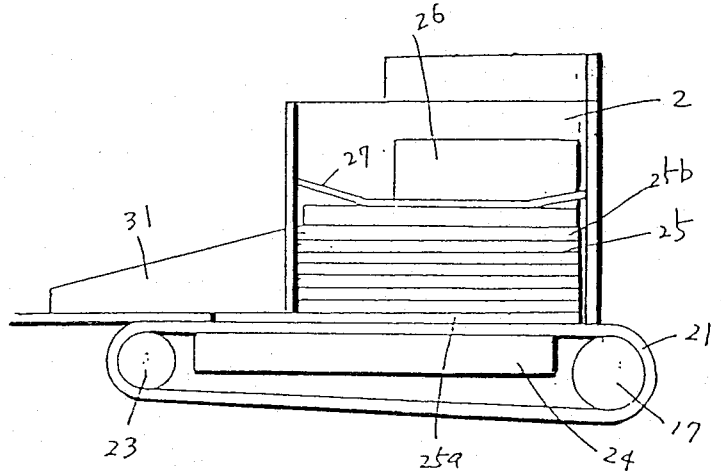
FIG. 14 is a fragmentary sectional view of the parts shown in FIG. 13 illustrating how the lowermost staple sheet is fed from the cartridge supply.
Figure 15:
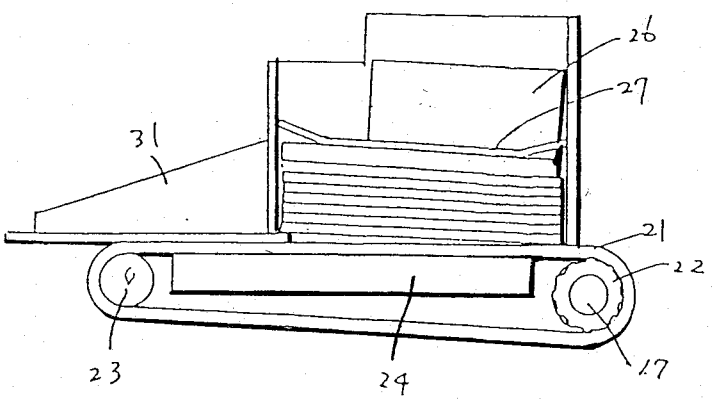
FIG. 15 is a view similar to FIG. 14 illustrating how the next lowermost staple sheet in the cartridge supply is moved into a position to be fed to the former-driver unit.
Figure 13:
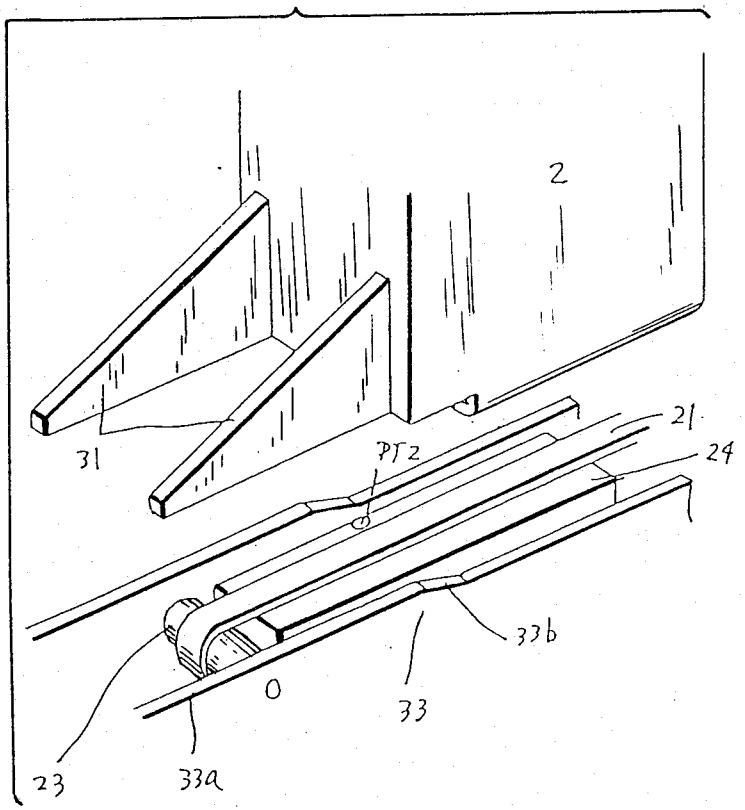
FIG. 13 is a fragmentary exploded perspective view of the parts of the stapler which function to feed successive staple sheets from the cartridge assembly supplying such staple sheets.

The unit 6 for forming and driving the unformed staples of the staple sheet 25 will be described in the following with reference to FIG. 6.

Figure 8:
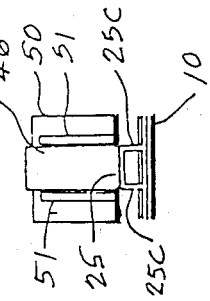
FIG. 8 is a view similar to FIG. 7 illustrating the manner in which the formed U-shaped staples are driven into the object to be stapled.
Figure 7:
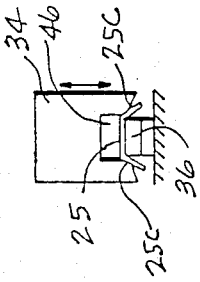
FIG. 7 is a generally schematic view illustrating the manner in which the unformed staples are formed into U-shaped staples.
Figure 10:
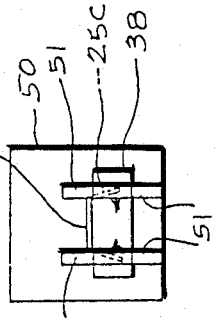
FIG. 10 is a view similar to FIG. 7 further illustrating the parts of the stapler which accomplish the forming of the unformed staples into a U-shaped staple.
Figure 9:
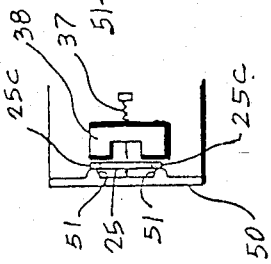
FIG. 9 is a view similar to FIG. 7 illustrating certain parts of the stapler which function to form the unformed staple elements into a U-shaped staple.
Figure 12:
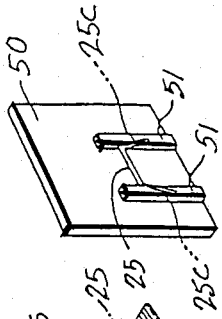
FIG. 12 is a view similar to FIG. 11 which illustrates the parts of the stapler which function to effect formation of the unformed staple into a U-shaped staple.
Figure 11:
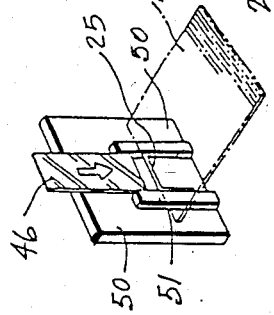
FIG. 11 is a fragmentary perspective view illustrating the parts of the stapler which function to drive the formed U-shaped staples.

The disclosure of U.S. Pat. No. 3,524,575 is known in the prior art as the apparatus for forming these straight unformed staple elements into the U-shape and for driving them. Consequently, the disclosure of that patent is hereby incorporated by reference into the present specification. In any of these apparatus, the paper sheets are clinched by moving the driver for driving the formed staples downward relative to the forming plate for forming the straight unformed staple element into the U-shape. As a result, a drive member for further moving the driver downward relative to the forming plate is required in addition to the drive member for moving the forming plate and the driver downward. In the apparatus disclosed in the patent, there is adopted a construction in which the portion 85 of the upper control member 25 is extended through the aperture 92 of the former 90 and is fitted in the aperture 99 of the driver blade 97 whereas the forwardly projecting portion 87 of the leaf spring 86 fixed to the upper control member 25 is retained in the slot 93 formed in the upper portion of the aperture 92 of the former 90. As has been described hereinbefore, the forming plate 34 and the driver 46 are integrally supported at their respective fitting holes **34*a* and 46*a* by the supporting projection 49 of the driver holder 47. The lower portion of the forming plate 34 is bifurcated to form legs 34*b* and 34*b* which have their facing inner sides sloped. The forming plate 34 is formed above its faces with notched recess 34*c* for receiving the projection 40*a* of the plate member when in the forming operation. The portions merging into the notched recess 34*c* and the slopes are flattened in a direction perpendicular to the moving direction of the forming plate 34 so that they coact, when the forming plate 34 reaches the bottom dead point, with the anvil portion 36 of the anvil device 35 located therebelow to form the straight staple held inbetween into the U-shape. The driver 46 is formed at its lower portion with a driving portion which is made to have a width substantially equal to that of the staple crown. The face plate 40 positioned in front of the driver 46 has its front wall formed at its upper portion with a notch for providing a relief for the supporting projection 48 of the driver holder 47. The paired vertical lands 51 formed on the lower portion of the back of the front wall of the face plate 50 have such a height from the back of the face plate 50 as is equal to that admitting the formed staple inserted. The lands 51 have their inner sides defining the path of the driving portion, and their shoulders facing that path are formed with arcuate slopes. By the upward movement of the aforementioned driver holder 47, the aforementioned forming plate 34 is moved up and down along the crests of those lands 51. The leading end of the staple sheet 25 fed by the endless belt 21 comes into abutment against the aforementioned lands 51 so that its further movement is blocked. If, in this state, the driver holder 47 is moved downward as a result of the downward movement of the actuating levers 43, the leading unformed staple of the staple sheet 25 abutting against the lands 51 are first pushed by the legs of the forming plate 34, because its central portion is placed on the anvil portion 36 (FIG. 7). As the unformed staple has its two ends bent to form legs 25*c*, the pusher portion 38 of the anvil device 35 then retracts relative to the anvil portion 36. When the forming plate 34 further moves downward to reach the bottom dead point, the staples are formed generally into the U-shape by the coaction between the anvil portion 36 and the flat portions of the forming plate 34. The staples thus U-shaped are held between the legs 34*b* of the forming plate 34, and in this state the forming plate 34 starts to move upward but is blocked by the projection 40*a* of the plate member 39 positioned above the staples. When the legs 34*b* of the forming plate 34 move upward to pass through the pusher portion 38, this portion 38 is moved toward the face plate 34 by the action of the spring 37 (FIG. 9) so that it pushes the legs of the formed staples onto the path formed in the face plate 50. At this time, the U-shaped staples are buckled to have their legs 25*c* diverging from their crown side to their open end (FIG. 12). Since the lands forming the path are formed with the aforementioned arcuate slopes, however, the formed staples have their inter-leg spaces corrected gradually narrower by those slopes, while they are pushed by the pusher portion 38 (FIG. 10) until they are fitted in that path (FIG. 11). The formed staples thus fitted in the path are driven toward the object 10 to be clinched out of the aforementioned path by the action of the driver 46 in the subsequent operation stroke (FIG. 8). Moreover, the face plate 50 has its front wall formed on its lower face with notches 50*a* (FIG. 3), which are directed upward at both the side portions of the path, and this path has its central portion formed at its lower end with a notch 50*b* directed upward. These respective notches 50*a* and 50*b* make it possible to easily eliminate therethrough the staples which are caused to clog the clearance between the face plate 50 and the front end of the assembly supporting member 8** by their insufficient feed or formation.

The feeder 7 of the staple sheets 25 will be described in detail in the following with reference to FIGS. 13–19. On the upper face of the endless belt 21 made to run on the rotating drive shaft 17 and the rotating support shaft 23, there is placed cartridge 2 which is charged with the unformed staple sheets 25. The cartridge 2 has its lower face opened as at **2*a* (FIG. 17) for effecting contact of the surface of the aforementioned endless belt 21 with the lower face of the staple sheets 25, and the front wall 28 has its lower portion opened to form the staple sheet let-off exit 32. The upper face of the endless belt 21 is arranged at a lever higher than the lower face of the lowermost staple sheet 25*a* in the cartridge 2, i.e., at a position intruding into the staple accommodating portion of the cartridge 2. Moreover, the height of the staple sheet let-off exit 32 of the cartridge 2, i.e., the gap between the upper face of a supporting portion 56 and the upper face of the let-off exit 32 is longer than the thickness of one or more staple sheets 25 so that the lowermost staple sheets 25*a* in the state having the cartridge 2 is mounted on the assembly supporting member 8 has its lower portion supported on the upper face of the endless belt 21 and its two sides guided by the two side walls 57 and 57 of the cartridge. As a result, the staple sheets 25 of the cartridge 2 can be maintained without fail in the state abutting against the endless belt 21. The staple guide rails 33 are disposed inside of the assembly supporting member 8 to extend from the front of the front wall 28 of the cartridge 2 to the anvil device 5 and to have their supporting guide portions 33*a* supporting and guiding the lower ends of the two sides of the staple sheet fed out by the endless belt 21 to the anvil device 35. Through the endless belt 21 and in a manner to face the staple sheet 25, on the other hand, there is mounted on the assembly supporting member 8 the magnet member 24, which is operative to attract the staple sheet 25 to the upper face of the endless belt 21 thereby to increase the frictional force inbetween. This magnet member 24 is interposed between the rotating drive shaft and support shafts 17 and 23 acting as the support shafts at the two end portions of the endless belt 21, and the front end of the magnet member 24 is positioned closer to the staple forming-driving unit 6 than the staple sheet let-off exit 32 of the cartridge 2 whereas the rear end of the supporting guide portions 33***a* of the staple guide rails 33 are positioned closer to the staple sheet let-off exit 32 than the front end of the aforementioned magnet member 24. Thanks to this construction, the staple let off from the staple let-off exit 32 of the cartridge 2 can receive the magnetic attracting force of the magnet member 24, even if its rear end is located in the vicinity of the aforementioned staple sheet let-off exit 32 so that it is smoothly fed out. Since the rear end of the supporting guide portions 33*a* of the staple guide rails 33 are positioned closed to the staple sheet let-off exit 32 than the front end of the aforementioned magnet member 24, slackness, if any, of the endless belt 21 is held by the magnet member 24 between the supporting guide portions 33*a* of the staple guide rails 33 and the staple accomodating portion of the cartridge 2. At a position closer to the driving portion than the supporting guide portions 33*a*, the staple sheets are supported by the supporting guide portions 33*a* of the staple guide rails 33 (FIG. 3) so that the preceding and succeeding sheet-shaped staples 25 are not overlaid one on the other but can always be fed smoothly and accurately. In order that the staple sheets 25 may be smoothly transferred to the aforementioned supporting guide portions 33*a*, moreover, these supporting guide portions 33*a* are formed with sloped portions 33*b* at their rear ends. The aforementioned endless belt 21 is rotationally driven during the one operation stroke of the stapler 1 thereby to feed the staple sheet 25, which is attracted to the upper face of the endless belt 21 by the magnet member 24, toward the forming-driving unit 6. The rotational movement of the endless belt 21 is set to be larger than the actual fed movement of the staple sheet 25 to establish slippage inbetween so that a pushing force can be applied to the staple sheet 25 to block the backward movement of the staple elements being formed. Moreover, the endless belt 21 is arranged to cover all the lower face of the cartridge 2 so that the pushing force is applied to the respective staple sheets even if these staple sheets are separated in the cartridge 2. Since the movement of the endless belt 21 is set at a larger value, the gap between the separated staple sheets is eliminated. As a result, the staple sheets can be continuously suppled to the forming-driving unit 6.

Figure 20:
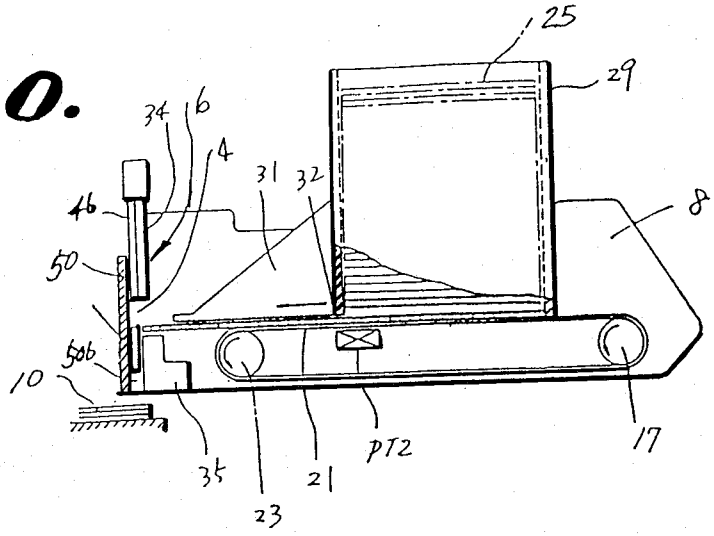
FIG. 20 is a vertical sectional view illustrating the manner in which the sheets are delivered from the cartridge supply to the forming and driving mechanism of the stapler.
Figure 22:
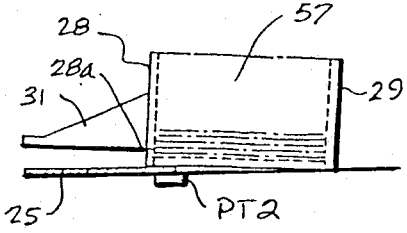
FIG. 22 is a side elevational view of the staple sheet supply cartridge assembly showing its relationship with the actuating switch just before a lowermost staple sheet has been completely fed from the cartridge.
Figure 21:
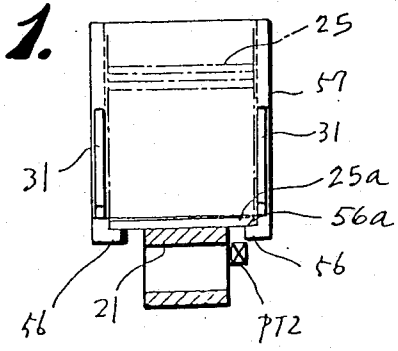
FIG. 21 is a view similar to FIG. 18 but with certain parts in section for purposes of clearer illustration.

As shown in FIGS. 20–22, the assembly supporting member 8 is arranged with a photosensor PT2 which is made operative to detect whether the staple sheet 25 is present or absent in the cartridge 2, at its portion corresponding to the staple sheet 25 in the cartridge 2 mounted therein but escaping the endless belt 21. On the other hand, the staple supporting portions 56 of the cartridge 2 are formed with notches 56*a*, which are cut away from the positions corresponding to the photosensor PT2 toward the let-off exit 32, and the push member 26 is formed at its opposite corners with notches 26*a* which are positioned to correspond to the photosensor PT2. The push member 26 is formed at its two sides with vertically rising walls 26*b* so that it is always held in the same position by the rising walls 26*b* facing the side walls 57 of the cartridge 2 even if this cartridge 2 is inclined with vibrations by making the rising walls 26*b* facing the inner faces of the cartridge side walls 57 with a slight gap when the push member 26 is accommodated in the cartridge 2. When the staple sheets in the cartridge 2 are consumed so that the uppermost staple sheet 25 comes into abutment against the endless belt 21 and is fed thereby to the forming-driving unit 6 until the rear end of the staple sheet 25 passes over the photosensor PT2, the notches 26*a* of the push member 26 allow the optical beam of the photosensor PT2 to transmit therethrough so that the photosensor PT2 can detect accurately and reliably that the staple sheets in the cartridge 2 are exhausted to the last. The optically transmissive and reflective photosensor is used as the sensor in the embodiments of the present invention. Thanks to the construction thus far described, however, the sensor should not be limited to the photosensor but can be exemplified by a mechanically operable detecting sensor which is equipped with such a member as will pop up or protrude when the last staple sheet left in the cartridge is let off. When the cartridge 2 is to be renewed as a result that it is detected by the photosensor PT2 that the staple sheets in the cartridge 2 are exhausted, moreover, the trailing end of the last staple sheet 25 is positioned in the notches portions 56*a* of the aforementioned cartridge 2 and already apart from the staple supporting portion 56 of the cartridge. Since there are arranged above the front of the staple sheet only the guide members 31 which project integrally from the cartridge 2, on the other hand, the cartridge 2 mounted can be removed from the cartridge accommodating portion with the last staple sheet being left on the staple guide rails 33, and a new staple sheet in cartridge 2 is freed from having its lower face overlying the upper face of the staple sheet 25 by the notches 56*a*, which receive the rear end of the staple sheet 25 left on the staple guide rails 33, so that the photosensor PT2 can respond again to the staple sheet 25 in the cartridge 2 to allow the clinching operation to be continued.

Figure 25:
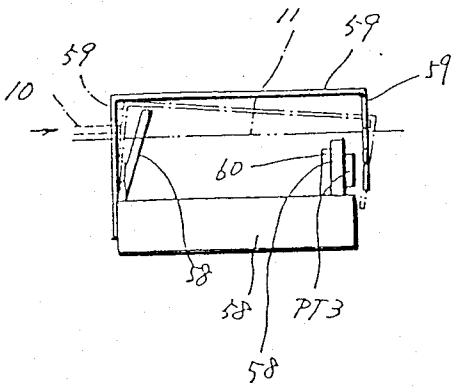
FIG. 25 is a side elevational view of the structure shown in FIG. 23.
Figure 23:
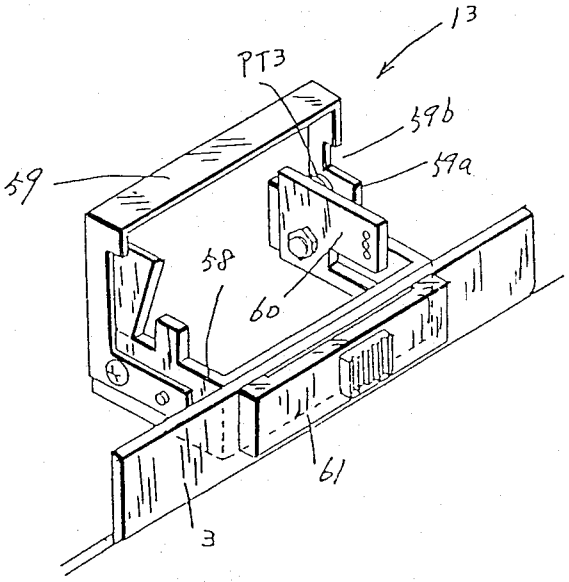
FIG. 23 is a fragmentary perspective view of the actuating switch assembly of the stapler.
Figure 24:
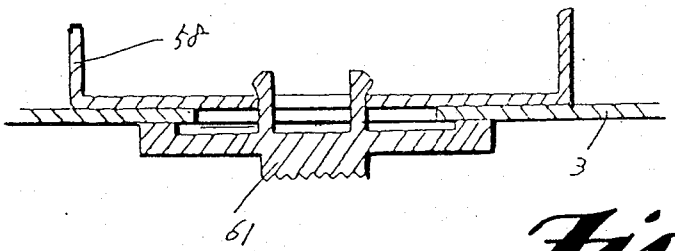
FIG. 24 is a sectional view taken along the line 24—24 of FIG. 23.

The start switch 13 will be described in the following with reference to FIGS. 23–25. The start switch 13 is constructed of a U-shaped frame 58, a leaf spring 59 fixed to one end of the frame 58, a switch base 60 fixed to the other end of the frame 58, a reflective photosensor PT3 mounted in the switch base 60, and an operating member 61 which has its portion fixed in the central opening of the frame 58 for slidably moving and operating the start switch 13 relative to the frame 58. The leaf spring 29 is made of a flexible spring material into a shape of letter "U" and has its one end fixed to one end of the frame 58 and its other leading end portion formed with an extension 59*a* and a notch 59*b*. The photosensor PT3 mounted in the switch base 60 is connected with a switch circuit which is formed in the switch base 60 and which is connected with the drive controller 15 of the stapler. Usually, the extension 59*a* of the leaf spring 59 is arranged in a position to correspond to the photosensor PT3 on the switch base 60. In order that one end of the leaf spring 59 may extend partially into the opening of the table 11 fixed on the frame 58 and may project above the table 11, the frame 58 is slidably held on the base 3, and the leaf spring 59 is positioned to contact with the inserted end portion of the paper when this paper is set on the table 11. The upright wall raised from the base 3 is opened to form a rectangular hole, through which the retaining member at the back face of the operating member 61 engages with the central opening of the frame 58. As a result, by moving the knob of the operating member 61 in the longitudinal direction of the rectangular hole of the upright wall of the base 3, the start switch 13 can be moved to vary the spacing of the end portion of the paper from the driver, i.e., the stapling position. The operations of the start switch 13 will be described in the following. First of all, with nothing being on the table 11, the extension of the leaf spring 59 faces the reflective photosensor PT3. If the paper is set on the table 11 relative thereto, the end portion of the paper inserted contacts with one end of the spring 59 so that the leaf spring 59 is caused to deflect by the load of that contact thereby to have its other end change position. Then, the notch 59*b* of the spring 59 faces the photosensor PT3 so that the electric motor 14 is started through a drive control circuit 100 to start the clinching operations.

Figure 26:
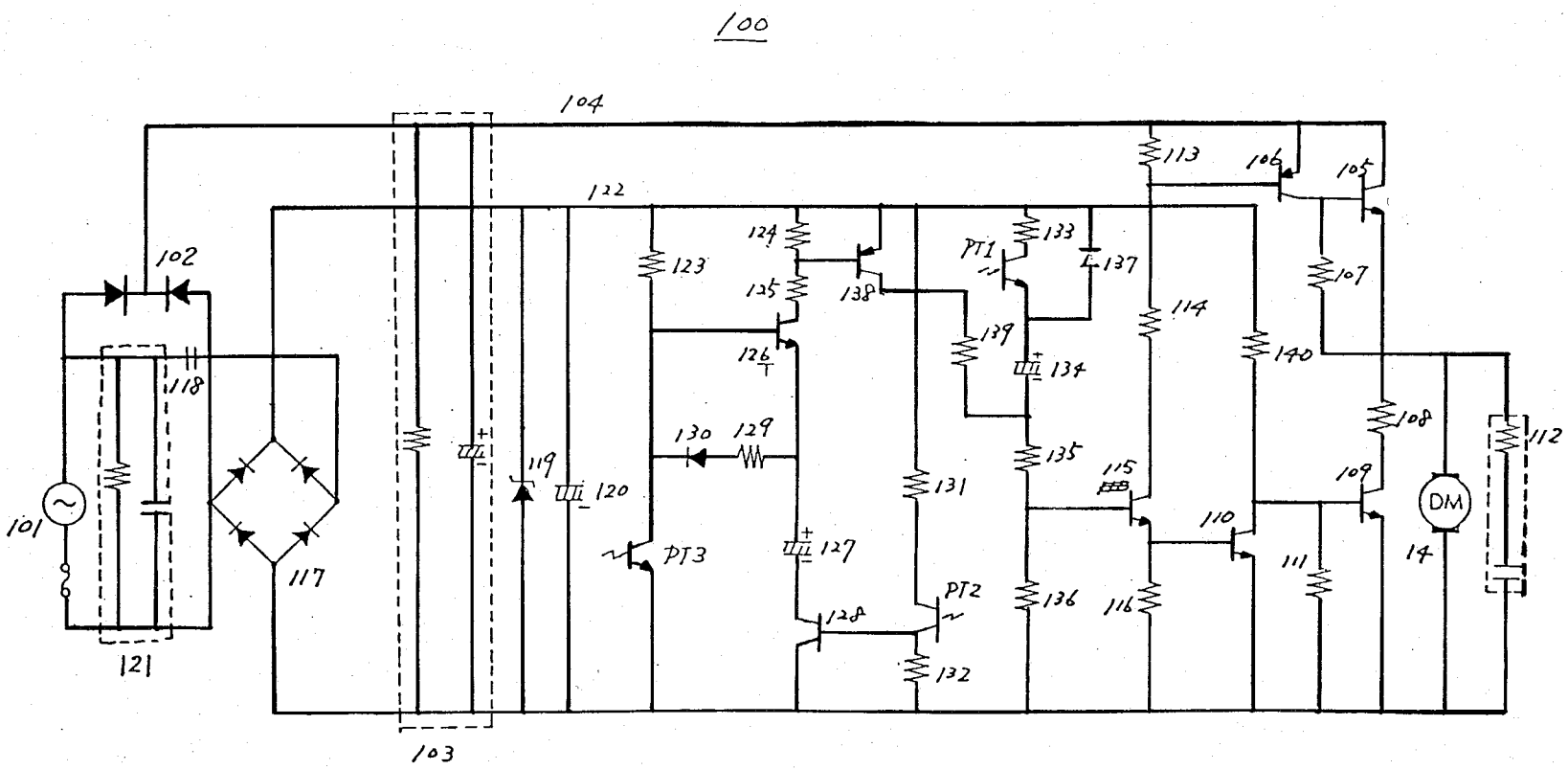
FIG. 26 is a wiring diagram illustrating the electric circuitry for controlling the stapler.

The drive control circuit 100 to be used with the electronic stapler according to the present invention will be described in the following with reference to FIG. 26. The power of an AC power supply 101 is rectified by a full-wave rectifier 102 and has its voltage smoothed by a smoothing circuit 103 which is composed of a resistor and a capacitor both connected in parallel with the power supply 101. The power 104 thus smoothed is supplied to the motor 14 through a drive circuit which is composed of a drive transistor 105, a transistor 106 and a base bias resistor 107. A stop circuit is connected in series with the aforementioned drive circuit and in parallel with the motor 14. This stop circuit is constructed of a bypass circuit which is composed of a limiting resistor 108, a stopping transistor 109, a transistor 110 and a resistor 111. Indicated at numeral 112 is a spark killer circuit which is connected in parallel with the motor 14. Between the positive terminal of the power 104 and the earth, there is connected between a switching circuit which as resistors 113 and 114, a transistor 115 and a resistor 116 connected in series. In order to establish the interlock between the drive transistor 105 of the drive circuit and the stopping transistor 109 of the stop circuit, in the switching circuit, the node between the resistors 113 and 114 and the node between the emitter of the transistor 115 and resistor 116 are connected with the bases of the respective transistors 106 and 110 of the drive circuit and the stop circuit, respectively. Incidentally, the drive and stop circuits may be composed of switching elements with control gates such as thyristors or triacs.

On the other hand, a full-wave rectifier 117 and a voltage dividing capacitor 118 are connected in series to drop the voltage of the AC power supply 101 to a predetermined voltage, which is smoothed by a Zener diode 119 and a smoothing capacitor 120. Indicated at numeral 121 is a noise eliminating circuit which is connected in parallel with the power supply 101.

This voltage dropping circuit has no part generating significant heat by inserting the voltage dividing circuit of the voltage dividing capacitor 118 thereby making it unnecessary to select the circuit base considering heat-resisting properties and to form gaps between the respective parts as in the prior art while considering the cooling efficiency so that the stapler can be small-sized in its entirety.

In parallel with the aforementioned smoothing capacitor 120, on the other hand, there is connected a circuit in which a resistor 123 having its one end connected with the positive terminal 122 of the power supply having the dropped voltage has its other end connected with the collector of the photosensor PT3 of the start switch. In parallel with this circuit, moreover, there is connected a starting circuit which has resistors 124 and 125, a transistor 126, a capacitor 127 and a transistor 128 connected in series. The transistor 126 has its collector connected with one end of the resistor 125 and its base connected with the collector of the photosensor PT3 of the start switch. The transistor 126 has its emitter connected with the positive terminal of the capacitor 127 whereas said capacitor 127 has its positive terminal connected through a resistor 129 and a diode 130 with the collector of the photosensor PT3 of the start switch thereby to form a discharge circuit. Between the positive terminals and the earth, there is connected a detecting circuit connected with the collector of a photosensor PT2 which is connected in series with the other end of a resistor having its one end connected with the positive terminal 122 for detecting the presence of the sheet-shaped staple 25 and which has its emitter grounded to the earth through a resistor 132. The emitter of the photosensor PT2 is further connected with the base of the transistor 128, which has its collector connected with the negative terminals of the capacitor 127 and its emitter grounded to the earth.

In parallel with that detecting circuit, moreover, there is connected a hold signal outputting circuit which has a CR time constant circuit. In this hold signal outputting signal, the photosensor PT1, which faces the disk 55 fixed on the rotating drive shaft 17 and having the notch 55*a* to detect the rotations of the rotating drive shaft 17, has its collector connnected through a resistor 133 with the positive terminal 122 and its emitter connected with a capacitor 134 and a resistor 135, which construct together the CR time constant circuit, and grounded to the earth through a resistor 136. The capacitor 134 has its positive terminal connected with the anode of a diode 137 which is connected in parallel with the photosensor PT1 and which has its cathode connected with the positive terminal 122. With the resistor 135, there is connected through a resistor 139 a transistor 138 which had its emitter connected with the resistor 124. The resistor 140 is a protecting resistor connected between the positive terminal 122 and the collector of the transistor 113. In the drive control circuit 100, the photosensor PT3 of the start switch 13 is held conductive, when the paper 10 is not inserted, but is switched into a nonconductive state when the paper 10 is inserted. The photosensor PT2 of the detecting circuit is rendered conductive in response to the reflection of the staple sheet 25, when this staple sheet 25 is in the cartridge 2, but is rendered nonconductive without the reflection of the staple sheet 25 when this staple sheet 25 becomes absent from the cartridge 2. The photosensor PT1 detective of the one cycle rotation of the rotating drive shaft 17 faces the notch 55*a* of the disk 55 at its initial state so that it is nonconductive. The notch 55*a* of that disk 55 is moved from the line of sight of the photosensor PT1 as a result of the rotations of the rotating drive shaft 17 so that the photosensor PT1 is switched to restore its conductive state, and is returned to the position to face the notch 55*a* after one rotation of the rotating drive shaft 17 so that the photosensor PT1 restores its nonconductive state.

The operations of this circuit will be described in the following. When the photosensor PT3 of the start switch 13 is rendered nonconductive as a result of the insertion of the paper 10, the transistor 126 of the starting circuit is turned on to set the transistor 138 conductive during the charging period of the capacitor 127. The collector output of the transistor 138 feeds a start signal to the switching circuit to turn on the transistor 115 of the switching circuit so that the drive transistor 105 is turned on through the drive transistor 106 of the drive circuit to feed the current to the motor 14 thereby to start the motor 14. At this time, the drive transistor 110 of the stop circuit is turned on so that the stopping transistor 109 is turned off.

As a result of the start of the aforementioned motor 14, the rotating drive shaft 17 starts its rotations so that the notch 55*a* of the disk 55 passes the photosensor PT1 of the hold signal outputting circuit. Then, the photosensor PT1 comes to face the portion of the disk 55 other than the notch so that the photosensor PT1 is turned on to output through the capacitor 134 and the resistor 135 the hold signal for holding the transistor 115 of the switching circuit in the conductive state. As a result, the switching circuit holds the drive circuit and the stop circuit in the aforementioned states so that the motor 14 is continuously rotated. Even, in this state, the photosensor PT3 of the start switch 13 is turned on, the drive circuit and the stop circuit are held in the previous states by the hold signal fed to the switching circuit so that the motor continues its rotations while the capacitor 134 of the CR time constant circuit of the hold signal outputting circuit is being charged.

Here, the capacitor 127 of the starting circuit is made to have such a capacitance as is necessary for continuously outputting the start signal to the switching circuit for the time period, for which the motor 14 is started to bring the photosensor 52 from the notch to the remaining portion of the disk so that the photosensor 52 is switched from the nonconductive state to the conductive state. As a result, the capacitor 127 is charged up, after the hold signal has been outputted, so that the transistor 126 is turned off to output no start signal.

After one cycle rotation of the rotating drive shaft 17, the photosensor PT1 faces again the notch 55*a* of the disk 55 so that it is rendered off. Then, no output signal is outputted from the hold signal outputting circuit to turn off the transistor 115 of the switching circuit so that the drive circuit is turned off whereas the stop circuit is turned on to stop the motor 14. Even if, in this state, the paper 10 remains in the state pressing the start switch 13, the capacitor 127 is already charged up so that the starting circuit is held inoperative so long as the photosensor PT3 of the start switch 13 is not rendered again conductive to discharge the potential of the capacitor 127 through the diode 130 and the photosensor PT3. As a result no start signal is outputted so that the drive circuit and the stop circuits are held inoperative and operative, respectively, to leave the motor 14 unstarted.

While the staple sheet 25 is present in the cartridge 2 so that the staple detecting photosensor PT2 is held conductive, the output of the detecting circuit holds the negative terminal of the capacitor 127 of the starting circuit in the grounded state through the transistor 128. When the photosensor PT3 of the start switch 13 is turned off by inserting the paper 10, the transistor 126 of the starting circuit is turned on so that it is held in the state capable of outputting the start signal.

In case the staple sheet 25 in the cartridge 2 is exhausted to the last so that the photosensor PT2 is rendered nonconductive, the transistor 128 is turned off so that the negative terminals of the capacitor 127 of the starting circuit is not grounded. As a result, the transistor 126 remains nonconductive, even if the photosensor PT3 of the start switch 13 is turned off, so that no start signal is outputted to leave the motor 14 unstarted.

When the stopping transistor 109 is turned on, the two terminals of the motor 14 turning inertially are short-circuited through the limiting resistor 108 so that a braking force is applied to abruptly stop the motor 14.

As has been described hereinbefore, the transistor 115 of the switching circuit coacts with the drive transistor 105 of the drive circuit to constitute the interlock with the stopping transistor 109 of the stopping circuit thereby to make it unnecessary to separately provide the switches for the driving and stopping operations. Since the drive circuit and the stop circuit are always switched to the opposite phases, moreover, there is no fear of the short-circuiting of the power supply. Therefore, the circuit can be simply constructed.

Next, the capacitor 134 of the hold signal outputting circuit is made in a normal state to have such a capacity as will be charged for a slightly longer time period than that after about one rotation of the notch 55*a* of the disk 55 from the position facing the photosensor PT1 and before the notch 55*a* of the disk 55 restores the position facing the photosensor PT1. As a result, even if a predetermined time period is elapsed for one cycle by the clogging of the staples or another trouble thereby to invite a state in which the notch 55*a* of the disk 55 fails to restore the position facing the photosensor PT1, the capacitor 134 is charged after lapse of the predetermined time period so that the output of the hold signal to be fed to the switching circuit is eliminated to turn off the switching circuit. As a result, the transistor 115 of the switching circuit is turned off, and the drive transistor 105 is also turned off whereas the stopping transistor 109 is turned on to stop the motor 14. As a result, not only the motor 14 but also the driving system can be prevented from being damaged.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

I claim:

1. A power-driven stapler adapted to use staple sheets comprising: a cartridge accommodating portion for accommodating a staple cartridge in which are stacked multiple layers of staple sheets, each of which is prepared by connecting a multiplicity of unformed non-U-shaped staple elements by means of an adhesive; feed path defining means formed in front of said accommodating portion for introducing staple sheets from a staple cartridge accommodated in said accommodating portion from the rear end thereof and for guiding the same to the front end thereof; feed means disposed to extend from said accommodating portion to said feed path defining means for consecutively and continuously feeding out the staple sheets from the staple cartridge accommodated in said accommodating portion onto said feed path defining means; forming means arranged in front of said feed path defining means for consecutively forming the staple elements of the staple sheets into staples having a U-shape; staple driver means for driving consecutively U-shaped staples formed by said forming means; clinching means for bending the leg portions of the driven staples; electric motor drive means for driving at least said feed means, said forming means and said staple driver means; and control means for controlling the drive of said electric motor drive means in a single cycle of the clinching step.

2. A stapler as set forth in claim 1, wherein said feed means includes: an endless belt made to run under tension between said staple cartridge accommodating portion and said feed path and rotationally driven for at least a portion of the period of the operating step of said electric motor drive means to move both the staple sheet in said staple cartridge and the staple sheet on said feed path toward said forming means; and magnetic means for attracting both the staple sheet facing the opening of said cartridge and the staple sheet on said feed path into close contact with the face of said endless belt, whereby staple sheets are consecutively and continuously fed out of a let-off exit, which is formed in the lower end of the front wall of said cartridge, toward said feed path while said endless belt is being rotationally driven.

3. A stapler as set forth in claim 2, wherein said magnetic means is a permanent magnet member arranged to magnetically attract the staple sheets in said staple cartridge and on said feed path through said endless belt.

4. A stapler as set forth in claim 1, wherein said forming means and said staple driver means include a forming plate and a driver plate arranged at the front end of the feed path of said staple sheets so as to slide up and down relative to said path and held by means of a drive holder for effecting integral engagement thereof for the sliding motions, said electric motor drive means including a drive shaft, an electric motor for rotationally driving said drive shaft, and an eccentric cam member fixed on said drive shaft driven on rotation during the clinching operation of said stapler; and actuating lever members having their central portions supported in a turning manner on the body of said stapler, said lever members having ends equipped with rollers engaged within cam grooves and opposite ends arranged in the vicinity of said drive holder, tension springs operatively connected between said opposite ends of said actuating lever members and said driver holder and cylinders mounted over said tension springs between said actuating lever members and said drive holder.

5. A stapler as set forth in claim 1, wherein said control means includes: paper detecting means arranged in the vicinity of said clinching means for detecting end edge of an object to be stapled; one-rotation detecting means for detecting one rotation of the rotating drive shaft for driving said staples; drive circuit means connected in series with said electric motor for supplying and shutting the drive current to said electric motor; stopping circuit means connected in parallel with said electric motor for braking the same when said electric motor is to be stopped; switching circuit means for switching and connecting said drive circuit means and said stopping circuit means in an interlock manner; starting circuit means made responsive to the detected signal of said paper detecting means for supplying a motor starting signal for a predetermined time period to said switching circuit means; hold signal outputting means made responsive to both the detected signal of said one-rotation detecting means by the rotation of said rotating drive shaft based on the start of said motor for outputting a hold signal to hold said switching circuit means in an operative state and the detected signal after normal one rotation for stopping the output of said hold signal; and safety circuit means connected between said hold signal outputting means and said switching circuit means and preset with a time period longer than that for the normal one-rotation drive for blocking said hold signal to said switching circuit means after said preset time period, in case the detection of said one-rotation detecting means is delayed, to forcibly turn off said switching circuit means.

6. A stapler as set forth in claim 5, further comprising detecting means disposed in said supply path of said staple sheet below said staple cartridge accommodating portion for detecting the presence of the staple sheet in said cartridge; and staple sheet residual detecting means made responsive to the detected signal of the absence of said staple sheet of said detecting means for making the start signal output of said starting circuit means ineffective to invite the state in which the stapler is not started.

7. A layered staple sheet cartridge comprising: staple sheets formed of a predetermined number of staple elements of generally straight configuration cut to have a predetermined length, adhered together in series with and adjacent to one another; a generally square accommodating portion accommodating said staple sheets in a stacked form; supporting members formed to extend from the lower ends of the two opposed side walls of said accommodating portion and made engageable with the two side edges of the lowermost one of said staple sheets for supporting the staple sheets accommodated therein; a staple sheet exit formed in the lower end of the front wall of said accommodating portion and having a limited size for letting off the lowermost one of said staple sheets forwardly; an opening formed in the lower face of said accommodating portion for exposing the lower face of the staple sheets accommodated in said accommodating portion to the outside along the feeding direction; and a staple material sheet push member for pushing the staple material sheets accommodated in said accommodating portion toward said lower end.

8. A staple sheet cartridge as set forth in claim 7, further comprising guide members formed on the lower end of the front wall of said staple sheet cartridge to merge the upper end edge of said staple sheet let-off exit and to extend in the direction to feed said staple sheet.

9. A staple sheet cartridge as set forth in claim 7, wherein said staple sheet cartridge has a front wall and an opposed rear wall formed with undulations on their respective inner faces, said staple sheet push member projecting to form flexible retaining portions which are coactive with said undulations for allowing said staple sheet push member to move downward but for blocking the upward movement of the same.

10. A staple sheet cartridge as set forth in claim 7, wherein said supporting members formed on the lower end edges of said staple sheet cartridge are formed with an opening which extends from such a portion to the front end thereof as corresponds to the detecting means arranged in the body of said stapler for detecting the staple sheets in said staple sheet cartridge; said staple sheet push member being cut away at portion corresponding to said detecting means.

* * * * *